US011686550B1

(12) United States Patent
Lin

(10) Patent No.: US 11,686,550 B1
(45) Date of Patent: Jun. 27, 2023

(54) SHOOTING TOY

(71) Applicant: Weihao Lin, Shantou (CN)

(72) Inventor: Weihao Lin, Shantou (CN)

( * ) Notice: Subject to any disclaimer, the term of this patent is extended or adjusted under 35 U.S.C. 154(b) by 0 days.

(21) Appl. No.: 17/993,938

(22) Filed: Nov. 24, 2022

(30) Foreign Application Priority Data

Oct. 26, 2022 (CN) ..... 202222833413.0

(51) Int. Cl.
*F41B 11/54* (2013.01)
*F41B 11/89* (2013.01)

(52) U.S. Cl.
CPC ..... *F41B 11/54* (2013.01); *F41B 11/89* (2013.01)

(58) Field of Classification Search
CPC ..... F41B 11/54; F41B 11/646; F41B 11/89
USPC ..... 124/48, 51.1, 56, 65, 72, 80, 82, 63; 446/473
See application file for complete search history.

(56) References Cited

U.S. PATENT DOCUMENTS 5,186,156 A * 2/1993 Clayton ..... F41B 11/55 124/66
5,535,729 A * 7/1996 Griffin ..... F41B 11/64 124/66
5,592,931 A * 1/1997 Johnson ..... F41B 11/681 124/63
5,596,978 A * 1/1997 Johnson ..... F41B 11/681 124/63
5,660,159 A * 8/1997 Clayton ..... F41B 11/646 124/66
5,709,199 A * 1/1998 Johnson ..... F41B 11/681 124/53.5
5,724,955 A * 3/1998 Johnson ..... F41B 11/57 124/53.5
5,787,869 A * 8/1998 Johnson ..... F41B 11/68 124/83
5,878,735 A * 3/1999 Johnson ..... F41B 11/681 124/59
5,924,413 A * 7/1999 Johnson ..... F41B 11/721 124/75
6,000,386 A * 12/1999 Johnson ..... F41B 11/89 124/71
6,003,503 A * 12/1999 Johnson ..... F41B 9/0018 124/71
6,428,384 B1 * 8/2002 Su ..... F41B 11/89 446/475

(Continued)

*Primary Examiner* — Alexander R Niconovich
(74) *Attorney, Agent, or Firm* — Daniel M. Cohn; Howard M. Cohn

(57) ABSTRACT

A shooting toy includes a gun body defining a bullet loading position and a launching position, a bullet loading device rotatably arranged on an outer side of the gun body, a pumping device communicated with the launching position, and a rotating device rotatably arranged in the gun body. The rotating device defines bullet accommodating cavities. The rotating device drives the bullet accommodating cavities to rotate in the gun body, so that the bullet accommodating cavities rotate to the bullet loading position and the launching position in turn. The bullet loading device loads soft bullets to the bullet loading position during a rotation process, so that the soft bullets are loaded in the bullet accommodating cavities. The pumping device pumps pressurized air to the launching position, so that each of the soft bullets is shot from the launching position under driving of the pressurized air.

10 Claims, 11 Drawing Sheets

(56) References Cited

U.S. PATENT DOCUMENTS

| | | | | |
|---|---|---|---|---|
| 7,287,526 | B1 * | 10/2007 | Bligh | F41B 11/643 124/63 |
| 7,458,371 | B2 * | 12/2008 | Ong | F41B 11/54 124/59 |
| 8,127,753 | B1 * | 3/2012 | Brooks | F41B 11/646 124/66 |
| 8,146,579 | B2 * | 4/2012 | Jablonski | F41B 11/646 124/65 |
| 8,387,605 | B2 * | 3/2013 | Brown | F41B 7/08 124/66 |
| 8,800,541 | B2 * | 8/2014 | Hu | F41A 33/06 124/66 |
| 8,875,689 | B2 * | 11/2014 | Chor-Ming | F41B 11/54 124/56 |
| 8,875,690 | B2 * | 11/2014 | Chor-Ming | F41B 11/89 124/56 |
| 9,027,541 | B2 * | 5/2015 | Huebl | F41B 11/681 124/56 |
| 9,086,252 | B2 * | 7/2015 | Wang | F41B 11/80 |
| 9,389,042 | B1 * | 7/2016 | Clayton | F41B 11/642 |
| 9,513,075 | B2 * | 12/2016 | Lallier | F41A 9/73 |
| 10,533,821 | B2 * | 1/2020 | Chia | F41B 11/54 |
| 10,533,824 | B2 * | 1/2020 | Lam | F41B 11/54 |
| 10,690,438 | B1 * | 6/2020 | Wei | F41B 11/54 |
| 10,859,337 | B1 * | 12/2020 | Bernal | F41B 7/08 |
| 10,907,929 | B2 * | 2/2021 | Bernal | F42B 6/00 |
| 11,353,279 | B2 * | 6/2022 | Chia | F41B 7/006 |
| 11,519,689 | B2 * | 12/2022 | Chia | F41B 11/54 |
| 2007/0034197 | A1 * | 2/2007 | Tschech | F41B 11/54 124/65 |

* cited by examiner

SHOOTING TOY

TECHNICAL FIELD

The present disclosure relates to a technical field of toys, and in particular to a shooting toy.

BACKGROUND

Shooting toys are configured to shoot soft bullets along a launching channel of the shooting toys. While having a strong sense of fun, the shooting toys also help to exercise a user's attention. Conventional shooting toys are generally classified based on an imitation of a shape of the shooting toys, a driving method of a driving mechanism that does the work on the soft bullets, or an impulse coefficient of the shoot toys after shooting the soft bullets.

However, no matter what kind of the shoot toys, there are following shortcomings.

A user needs to manually load the soft bullets one by one to a launching position, operations of which are tedious.

The soft bullets cannot be shot continuously. The shooting toy's continuous shooting performance is poor.

SUMMARY

A technical problem to be solved by the present disclosure is to provide a shooting toy with easy operation and excellent continuous shooting performance.

The present disclosure provides a shooting toy. The shooting toy comprises a gun body defining a bullet loading position and a launching position, a bullet loading device rotatably arranged on an outer side of the gun body, a pumping device communicated with the launching position, and a rotating device rotatably arranged in the gun body.

The rotating device defines a plurality of bullet accommodating cavities in a circumferential direction thereof. The rotating device is configured to drive the plurality of bullet accommodating cavities to rotate in the gun body, so that the plurality of bullet accommodating cavities rotates to the bullet loading position and the launching position in turn.

The bullet loading device is configured to load soft bullets to the bullet loading position during a rotation process, so that the soft bullets are one-to-one loaded in the plurality of bullet accommodating cavities.

The pumping device is configured to pump pressurized air to the launching position, so that the pressurized air is pumped to each of the bullet accommodating cavities during the rotation process, and each of the soft bullets is shot from the launching position under driving of the pressurized air.

In some embodiments, the bullet loading device comprises a bullet loading support detachably arranged on the gun body, a bullet driving piece arranged on the bullet loading support, and an annular frame rotatably arranged on the bullet loading support.

A plurality of clamping grooves are provided in the annular frame. Each of the clamping grooves is configured to accommodate a corresponding soft bullet of the soft bullets. The bullet driving piece is configured to drive the annular frame to rotate, so that the plurality of clamping grooves rotates and is communicated with the bullet loading position one by one in the rotation process, and the soft bullets accommodated in the plurality of clamping grooves fall into the bullet loading position one by one.

In some embodiments, an edge of the bullet loading position protrudes outwards to form a bullet scraping boss. When the annular frame rotates, the bullet scraping boss pushes each of the soft bullets from a corresponding clamping groove of the plurality of clamping grooves, so that each of the soft bullets falls into the bullet loading position.

In some embodiments, the pumping device comprises a pumping cylinder communicated with the launching position, a piston slidably arranged in the pumping cylinder, and a pumping driving assembly connected with the piston. The pumping driving assembly drives the piston to slide in the pumping cylinder, so that the pressurized air in the pumping cylinder is pumped to the launching position.

In some embodiments, the pumping driving assembly comprises a pumping motor, a pumping intermittent gear connected with the pumping motor, a rack arranged on the piston, and a pumping elastic piece connected with the piston.

The pumping motor is configured to drive the pumping intermittent gear to rotate, so that the pumping intermittent gear is intermittently engaged with the rack.

When the rack is engaged with the pumping intermittent gear, the pumping intermittent gear is configured to drive the rack to slide, so that the piston slides in a direction exiting the pumping cylinder, and the pumping elastic piece deforms to generate elastic potential energy. When the rack is separated from the pumping intermittent gear, the elastic potential energy of the pumping elastic piece is released, so that the pumping elastic piece drives the piston to slide in a direction entering into the pumping cylinder.

In some embodiments, an air outlet nozzle is arranged on the pumping cylinder. The air outlet nozzle extends to abut against the gun body. The air outlet nozzle is aligned with and communicated with the launching position.

In some embodiments, the rotating device comprises a rotating driving piece arranged on the gun body, a rotating disk rotatably arranged in the gun body, and a rotating column arranged on the rotating disk.

The rotating column is arranged in the gun body. A plurality of accommodating grooves are formed in the rotating column in a circumferential direction thereof. Each of the accommodating grooves defines a corresponding bullet accommodating cavity in the rotating column. The rotating driving piece is configured to drive the rotating disk to rotate, so that the rotating disk drives the rotating column to rotate and the rotating column drives the soft bullets to rotate.

In some embodiments, the gun body further defines a shell unloading position.

The shooting toy further comprises a plurality of shell unloading aids, and the plurality of shell unloading aids is one-to-one arranged in the plurality of bullet accommodating cavities.

When one of the plurality of bullet accommodating cavities is in the bullet loading position, a corresponding shell unloading aid of the plurality of shell unloading aids is configured to fix a corresponding soft bullet falling into the one of the plurality of bullet accommodating cavities via the bullet loading position.

When the one of the plurality of bullet accommodating cavities is in the launching position, the corresponding shell unloading aid is configured to guide the pressurized air from the pumping device to the corresponding soft bullet, so that the corresponding soft bullet is shot out.

When the one of the plurality of bullet accommodating cavities is rotated to the shell unloading position, the corresponding shell unloading aid is further configured to release the corresponding soft bullet in a vacant state, so that the corresponding soft bullet is ejected through the shell unloading position.

In some embodiments, the gun body further comprises a rotating cylinder. The rotating device is arranged in the rotating cylinder. A guide track is arranged on an inner wall of the rotating cylinder. The bullet loading position, the launching position, and the shell unloading position are defined on a side wall of the rotating cylinder and correspond to different positions of the guide track.

Each of the shell unloading aids comprises a fixing base defining a fixing groove and an air guide channel, an elastic piece connected to the fixing base, a fixing piece arranged in the fixing groove, and a shell unloading piece slidably arranged on the fixing base.

The air guide channel is configured to guide the pressurized air to flow. When the rotating device rotates in the rotating cylinder, each fixing base moves along the guide track under an elastic force of each elastic piece, so that each fixing base slides in each of the bullet accommodating cavities.

When a corresponding fixing base of the corresponding shell unloading aid moves into a corresponding shell unloading position along the guide track, a corresponding shell unloading piece stretches into a corresponding fixing groove, so that the corresponding soft bullet is jacked to incline and is separated from a corresponding fixing piece. Then the corresponding soft bullet is ejected from a corresponding fixing groove and is ejected through the shell unloading position. When the corresponding fixing base moves out of the shell unloading position along the guide track. The corresponding shell unloading piece resets and moves out of the corresponding fixing groove.

In some embodiments, a guide convex wall is arranged on the inner wall of the rotating cylinder along the guide track.

A guide boss facing the guide convex wall is arranged on each fixing base. Each guide boss is configured to abut against the guide convex wall under an action of each elastic piece. A first end of each air guide channel is exposed on each guide boss, and a second end of each air guide channel is exposed in each fixing groove.

The shooting toy of the presently disclosure relates to a technical field of toys. The bullet loading device automatically loads the soft bullets. The rotating device automatically pushes the soft bullets loaded to the bullet loading position to the launching position one by one, and the pumping device boosts the soft bullets to shot out. During a shooting process, the rotating device continuously pushes the soft bullets to the launching position, and the pumping device boosts and shoots each of the soft bullets that moves to the launching position.

Thus, the shooting toy eliminates tedious manual loading of the soft bullets, improves a convenience of operation, and further realizes continuous shooting of the soft bullets, which makes the shooting toy have excellent continuous shooting performance.

BRIEF DESCRIPTION OF DRAWINGS

The present disclosure will be further described below in conjunction with accompanying drawings and examples. In the drawings.

DETAILED DESCRIPTION

For clear understanding of technical features, purposes, and effects of the present disclosure, specific embodiments of the present disclosure are described in detail with accompanying drawings.

Figure 1:
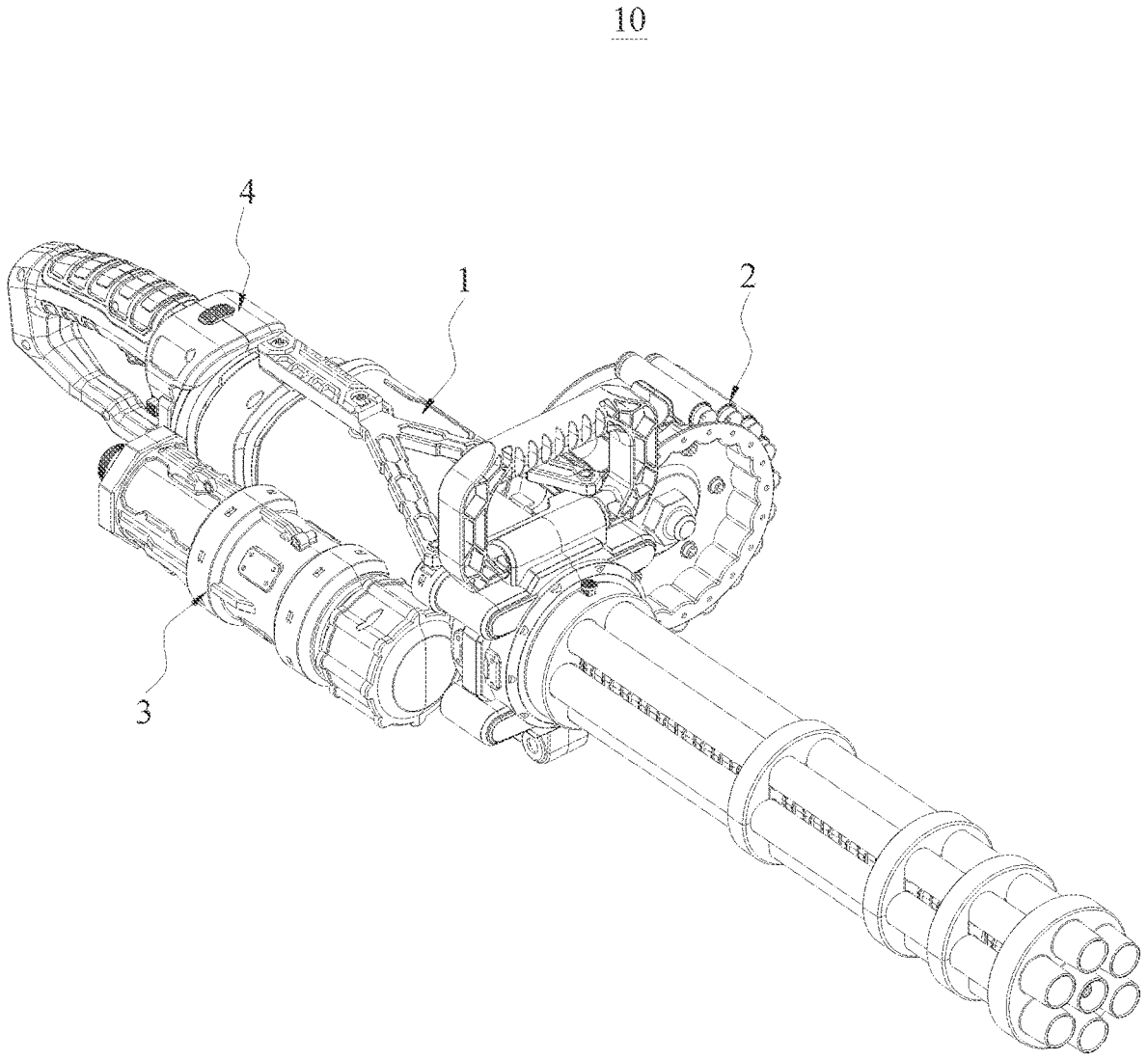
FIG. 1 is a schematic diagram of a shooting toy according to one optional embodiment of the present disclosure.
Figure 2:
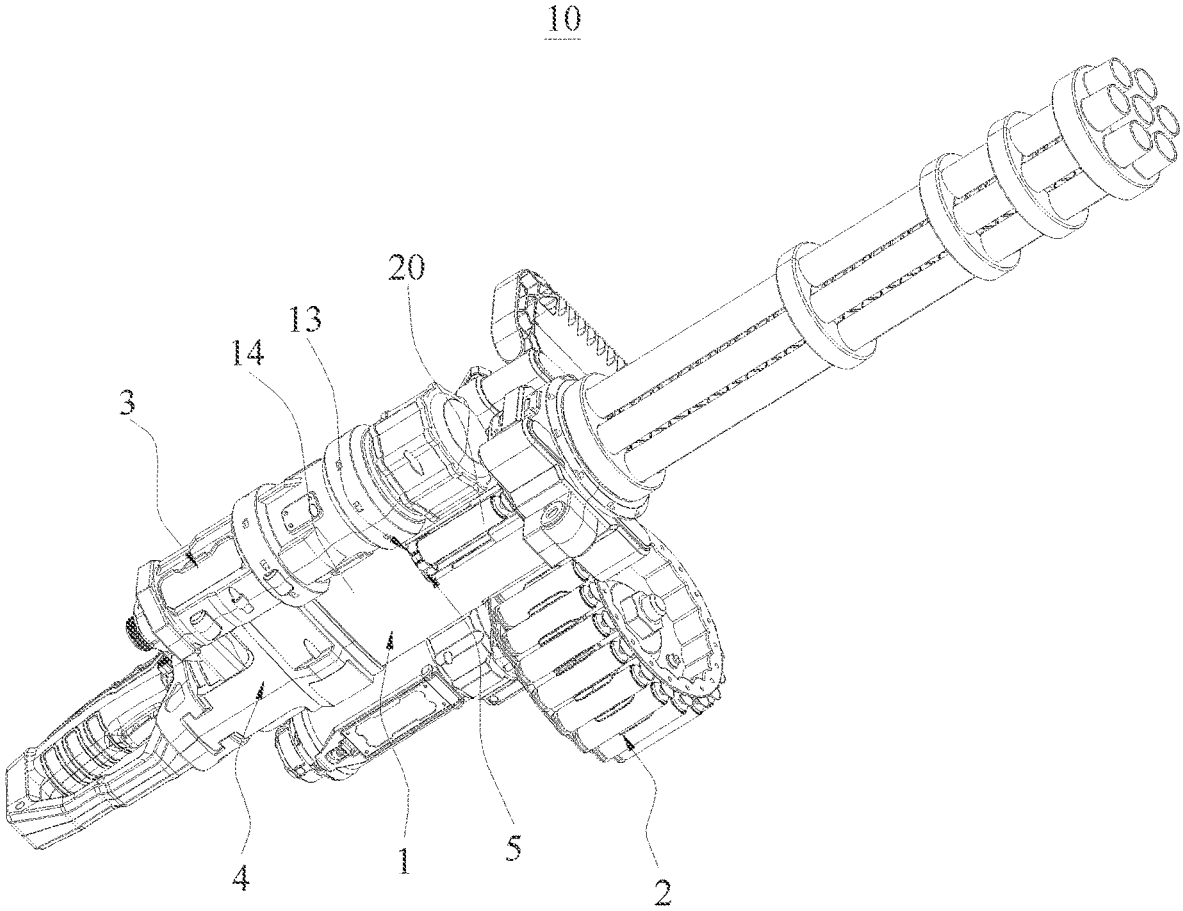
FIG. 2 is another schematic diagram of the shooting toy according to one optional embodiment of the present disclosure.
Figure 10:
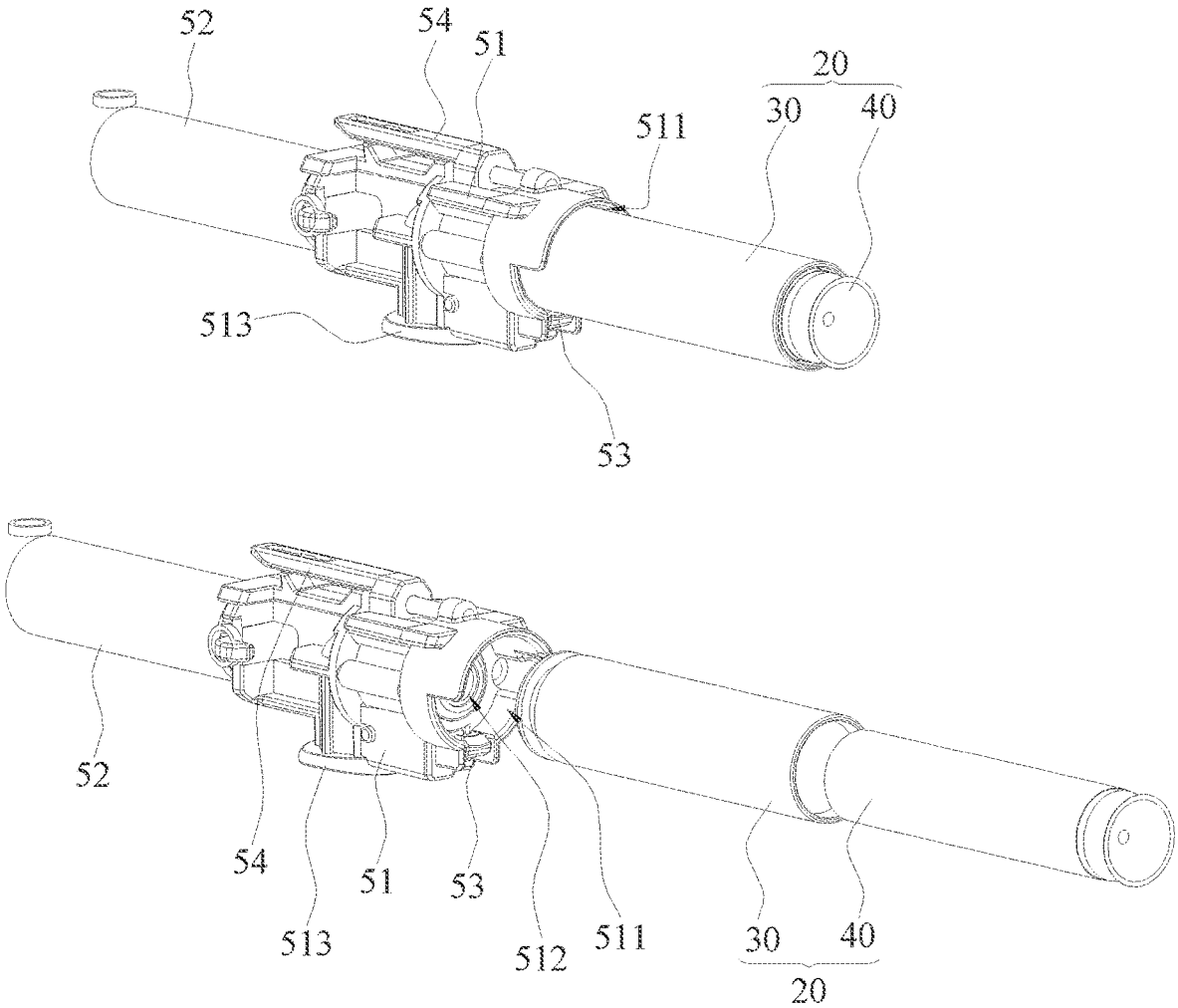
FIG. 10 is a schematic diagram showing shell unloading aids and soft bullets according to one optional embodiment of the present disclosure.
Figure 11:
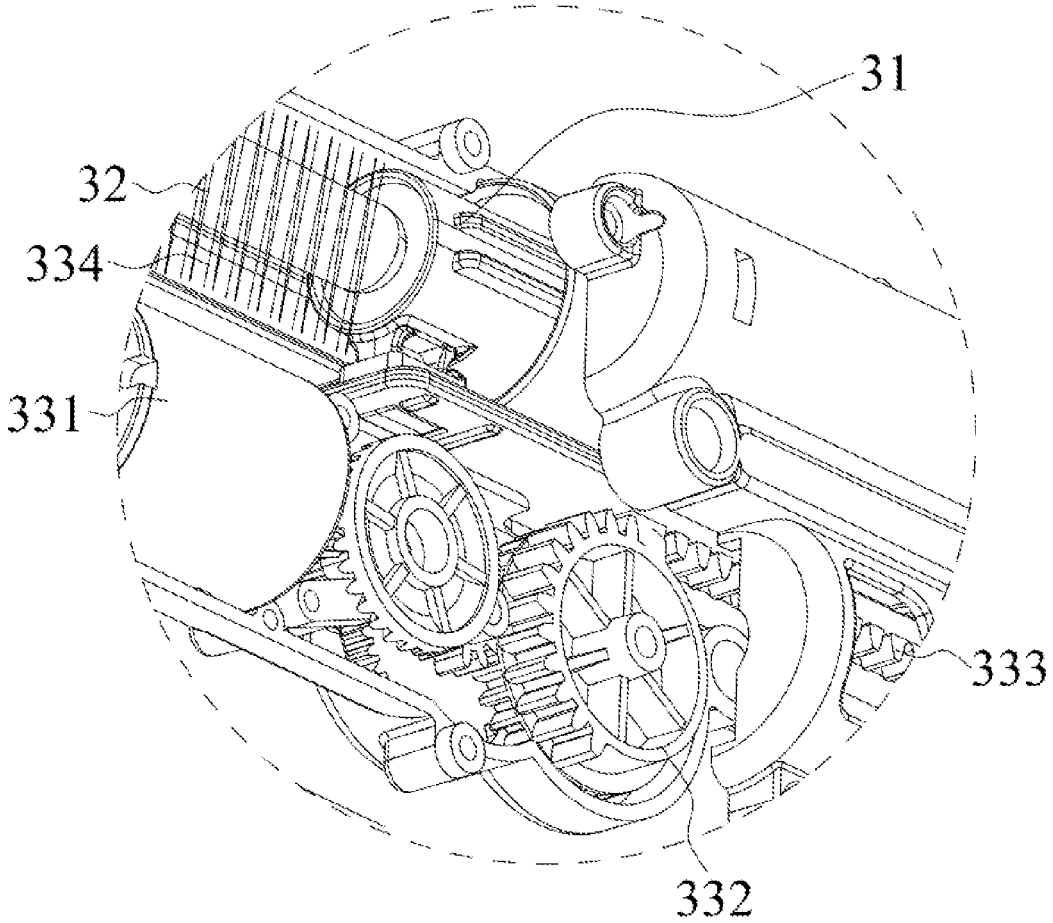
FIG. 11 is an enlarged schematic diagram of area C shown in FIG. 5.

FIGS. 1 and 2 show the shooting toy 10 according to one optional embodiment of the present disclosure. The shooting toy 10 is configured to shoot the soft bullets 20 as shown in FIG. 10. Specifically, each of the soft bullets 20 comprises a bullet shell 30 and a bullet body 40 arranged in the bullet shell 30. After each bullet body 40 is shot, each bullet shell 30 should be ejected. In other words, each used soft bullet is in a vacant state, and each used soft bullet in the vacant state is each bullet shell 30 that is left after each bullet body 40 is shot.

As shown in FIGS. 2-7, the shooting toy 10 comprises a gun body 1 defining a bullet loading position 11 and a launching position 12, a bullet loading device 2 rotatably arranged on an outer side of the gun body 1, a pumping device 3 communicated with the launching position, and a rotating device 4 rotatably arranged in the gun body 1.

It is understood that the gun body 1 is configured to mount other mechanisms of the shooting toy 10. The bullet loading position 11 provides space for the soft bullets 20 to be loaded into the gun body 1 and enables the soft bullets 20 to be further loaded into the rotating device 4. The launching position 12 provides space for the soft bullets 20 to be shot out of the gun body 1. The bullet loading device 2 automatically loads the soft bullets 20 to the bullet loading position 11. The rotating device 4 fixes each of the soft bullet s20 loaded to a relative fixed position through the bullet loading position 11 and rotates each of the soft bullets 20, so that each of the soft bullet s20 rotates in a circumferential direction of the gun body 1 along a predetermined trajectory, and the soft bullets 20 are rotated to the launching position 12 one by one and are shot out one by one.

The pumping device 3 is configured to generate pressurized air and is configured to pump the pressurized air to the launching position 12. The soft bullets 20 are pushed by the pressurized air to shoot out. Specifically, the pressurized air pushes each bullet body 40, and each bullet shell 30 is left and is in the vacant state. Each bullet shell 30 needs to be ejected subsequently, so that other soft bullets 20 loaded from the bullet loading position 11 are capable of being accommodated in a plurality of bullet accommodating cavities 431.

The rotating device 4 defines the plurality of bullet accommodating cavities 431 in a circumferential direction thereof. The rotating device 4 is configured to drive the plurality of bullet accommodating cavities 431 to rotate in the gun body 1, so that the plurality of bullet accommodating cavities 431 rotates to the bullet loading position 11 and the launching position 12 in turn.

It is understood that each of the bullet accommodating cavities 431 is configured to accommodate only one soft bullet 20, avoiding two soft bullets 20 arranged in the same bullet accommodating cavity from interfering with each other and improving a shooting yield of the soft bullets 20. Relative positions of the plurality of bullet accommodating cavities 431 in the rotating device 4 are constant. Optionally, a spacing between each two adjacent bullet accommodating cavities 431 is configured to be equal, and each of the bullet accommodating cavities 431 has a circumferentially symmetrical structure.

It is also understood that each of the bullet accommodating cavities 431 may be a hole or a slot, or each of the bullet accommodating cavities 431 may be enclosed by various limit structures. In order to prevent the soft bullets 20 from loosening during rotation, the soft bullets 20 are fixed by the plurality of bullet accommodating cavities 431 together with the gun body 1 on the one hand, and the soft bullets 20 are fixed by fixing structures in the plurality of bullet accommodating cavities 431 on the other hand. Of course, the soft bullets 20 can be fixed by other common structures in magnetic suction technology and snap technology.

The bullet loading device 2 is configured to load the soft bullets 20 to the bullet loading position 11 during a rotation process, so that the soft bullets 20 are one-to-one loaded in the plurality of bullet accommodating cavities 431. The pumping device 3 is configured to pump the pressurized air to the launching position 12, so that the pressurized air is pumped to each of the bullet accommodating cavities 431 during the rotation process, and each of the soft bullets is shot from the launching position under driving of the pressurized air.

In actual use, after the soft bullets 20 are loaded to the gun body 1 through the bullet loading position 11, the rotating device 4 rotates and sequentially aligns each of the bullet accommodating cavities 431 with the loading position 11. If each of the bullet accommodating cavities 431 aligned with a corresponding soft bullet 20 is in a vacant state, each of the soft bullets 20 entering the gun body 1 through the bullet loading position 11 falls into each of the bullet accommodating cavities 431. Thus, loading of the soft bullets 20 is completed.

Each of the soft bullets 20 loaded in each of the bullet accommodating cavities 431 rotates along the predetermined trajectory under driving of the rotating device 4, i.e., after each of the bullet accommodating cavities 431 is sequentially moved to the bullet loading position 11, each of the bullet accommodating cavities 431 further rotates and moves sequentially to the launching position 12.

The pumping device 3 pumps the pressurized air to each of the bullet accommodating cavities 431 moved to the launching position 12, so that the soft bullets 20 are automatically shot one by one on the basis of automatically moving to the launching position 12 one by one, further improving the ease of use.

Figure 3:
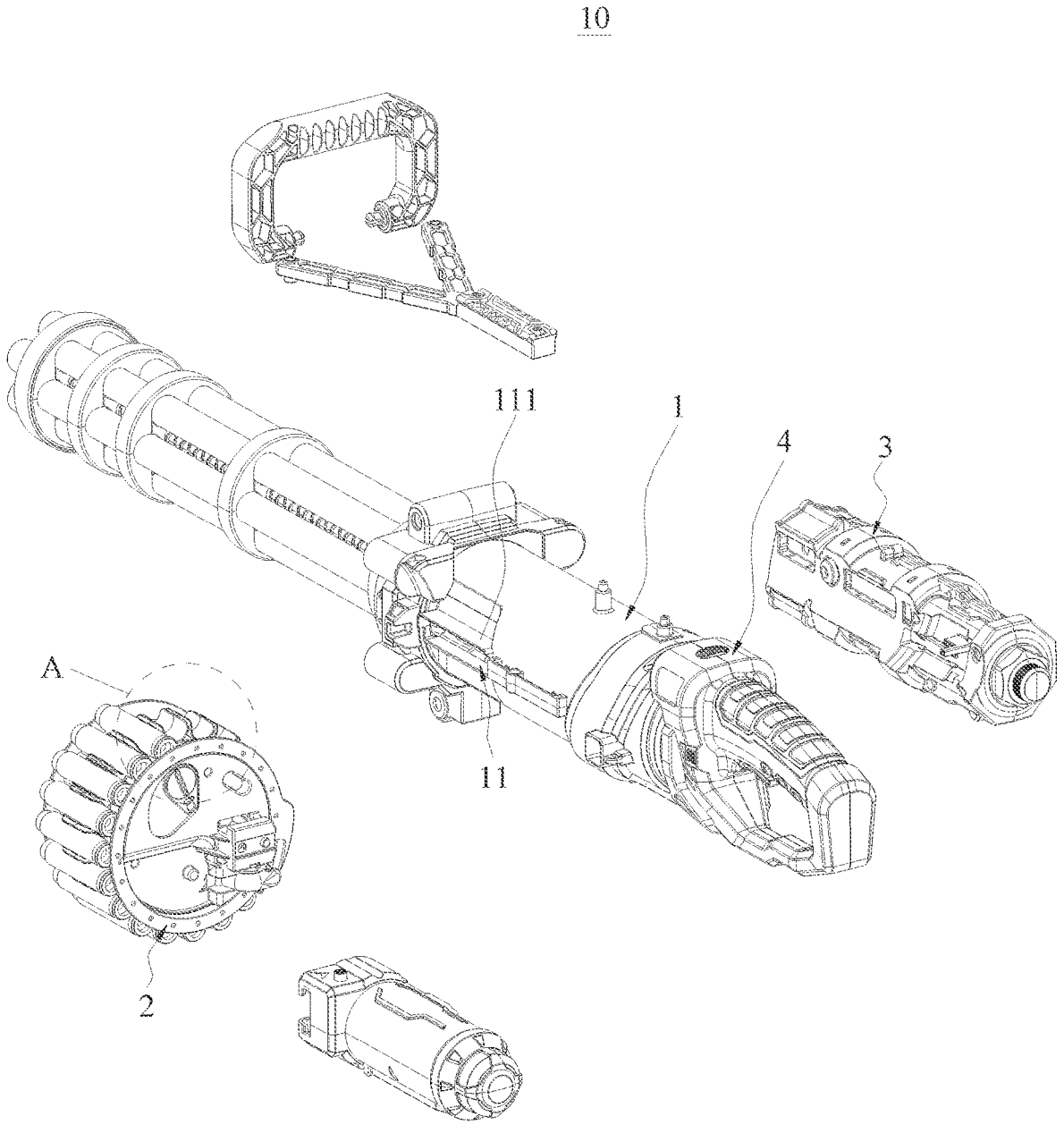
FIG. 3 is an exploded schematic diagram of the shooting toy shown in FIG. 1.
Figure 5:
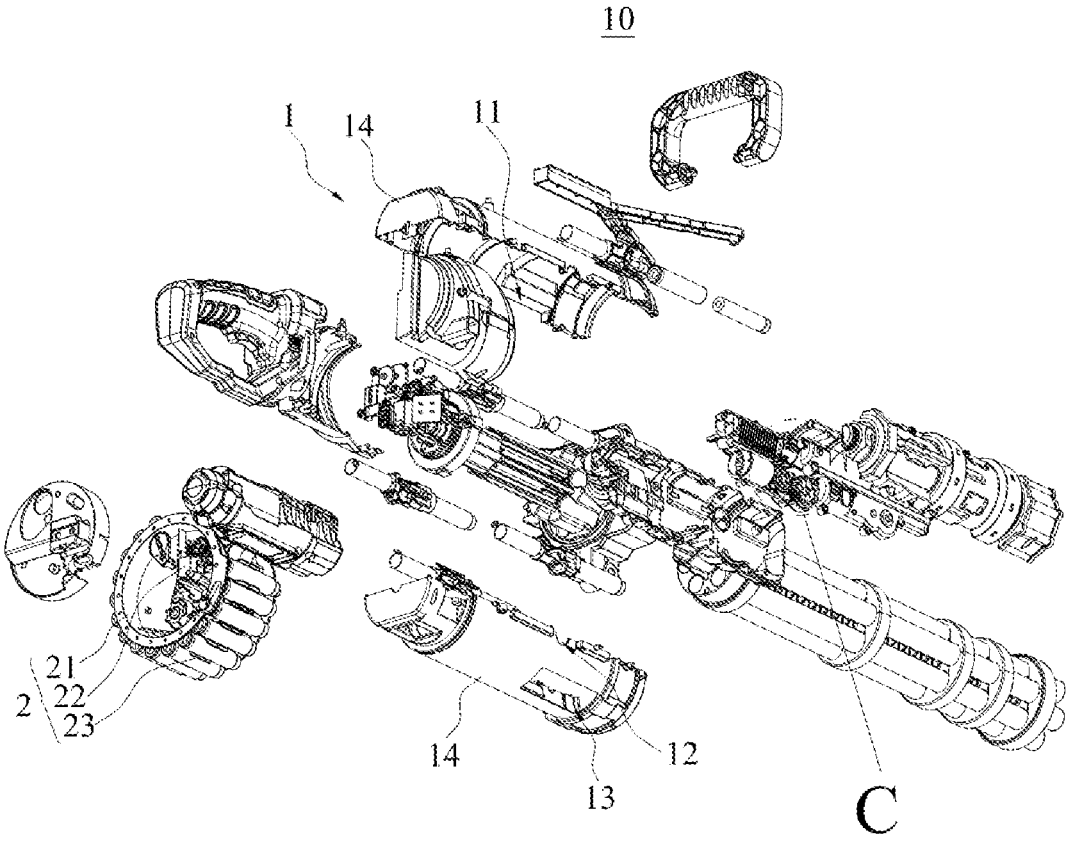
FIG. 5 is another exploded schematic diagram of the shooting toy shown in FIG. 4.
Figure 8:
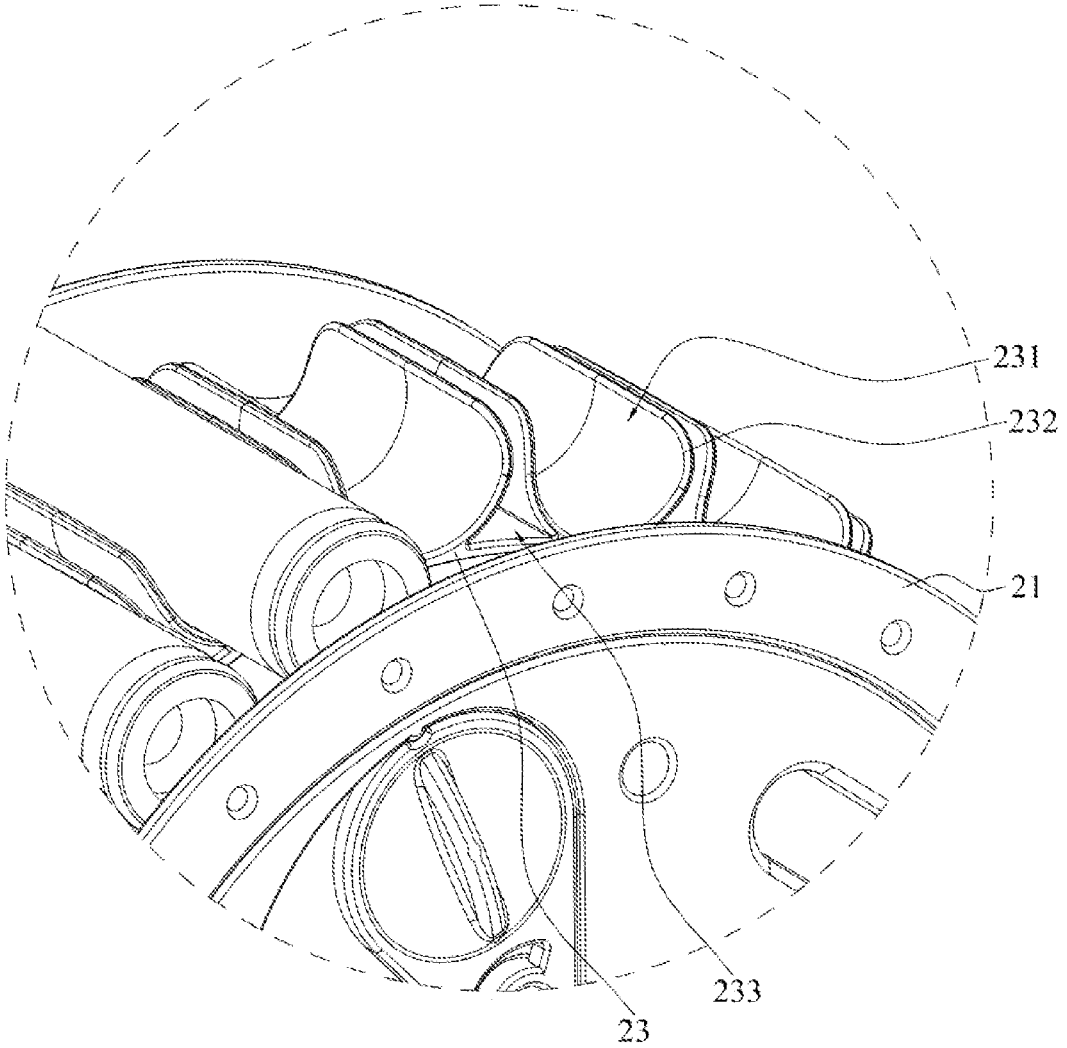
FIG. 8 is an enlarged schematic diagram of area A shown in FIG. 3.

As shown in FIGS. 3, 5, and 8, in some embodiments, the bullet loading device comprises a bullet loading support 21 detachably arranged on the gun body 1, a bullet driving piece 22 arranged on the bullet loading support 21, and an annular frame 23 rotatably arranged on the bullet loading support 21.

A plurality of clamping grooves 231 are provided in the annular frame 23. Each of the clamping grooves 231 is configured to accommodate a corresponding soft bullet of the soft bullets 20. The bullet driving piece 22 is configured to drive the annular frame 23 to rotate, so that the plurality of clamping grooves 231 rotates and is communicated with the bullet loading position 11 one by one in the rotation process, and the soft bullets 20 accommodated in the plurality of clamping grooves 231 fall into the bullet loading position 11 one by one.

It is understood that the bullet loading support 21 may be connected to the gun body 1 by a plug-in structure and/or a magnetic structure. The bullet loading support 21 is not only configured to mount the bullet driving piece 22, but also provides rotation space for rotation of the annular frame 23. The bullet driving piece 22 provides a driving force driving the annular frame 23 to rotate. The bullet driving piece 22 and the annular frame 23 may be driven by gears and/or rings engaged with each other, by multiple gears engaged in sequence, or by means of belt drive. The annular frame 23 is in a shape of a ring. Accordingly, a groove or a step for the rotation of the annular frame 23 therein may be provided on the bullet loading support 21. Optionally, an annular groove may be provided in an outer circumference of the bullet loading support 21 and the annular groove is configured to accommodate the annular frame 23 and guide the annular frame 23 to rotate. A profile of a grove wall of each of the clamping grooves 231 is matched with a profile of each of the soft bullets 20, and each of the clamping grooves 231 is configured to fix each of the soft bullets 20.

It is also understood that each bullet shell 30 of each of the soft bullets 20 is clamped in the groove wall of a corresponding clamping groove 231 through a clamping structure, or each bullet shell 30 is magnetically connected with the corresponding clamping groove 231 by a magnetic structure, or each bullet shell 30 is connected with the corresponding clamping groove 231 by other structures in the prior art capable of performing a similar fixing function, which is not limited therein.

Optionally, as shown in FIG. 8, in some embodiments, a plurality of arc clamping plates 232 is arranged on the annular frame 23. The plurality of arc clamping plates 232 is arranged along an outer edge of the annular frame 23 at intervals. The plurality of arc clamping plates 232 is uniformly arranged around a central axis of the annular frame 23. The plurality of arc clamping plates 232 defines the plurality of clamping grooves 231.

It is understood that each of the soft bullets 20 is correspondingly clamped and fixed in each two adjacent arc clamping plates 232. That is, the plurality of arc clamping plates 232 is arc-shaped and has a certain degree of elasticity to firmly clamp the soft bullets 20, preventing the soft bullets from accidental loosening during the rotation process.

In particular, it should be noted that a deforming gap 233 is defined between each two adjacent arc clamping plates 232. During a process that each of the soft bullets 20 is pushed from corresponding arc clamping plates 232 and falls into the bullet loading position 11, the corresponding arc clamping plates 232 deform, and a corresponding deforming gap 233 defined between the corresponding arc clamping plates 232 prevents the corresponding arc clamping plates 232 from compressing an adjacent arc clamping plate 232. That is, each deforming gap 233 is configured to prevent an adjacent soft bullet 20 from withdrawing from corresponding arc clamping plates 232.

As shown in FIGS. 3-7, in some embodiments, an edge of the bullet loading position 11 protrudes outwards to form a bullet scraping boss 111. When the annular frame 23 rotates, the bullet scraping boss 111 pushes each of the soft bullets 20 from a corresponding clamping groove 231 of the plurality of clamping grooves 231, so that each of the soft bullets 20 falls into the bullet loading position 11.

It should be noted that a protrusion degree of the bullet scraping boss 111 can be flexibly set. However, in the case that each of the soft bullets 20 is pushed out, the bullet scraping boss should not abut against with any of the plurality of clamping grooves 213, i.e., the bullet scraping boss 111 should not impede the rotation of the annular frame 23. Therefore, a normal operation of the bullet loading device 2 is ensured.

Figure 4:
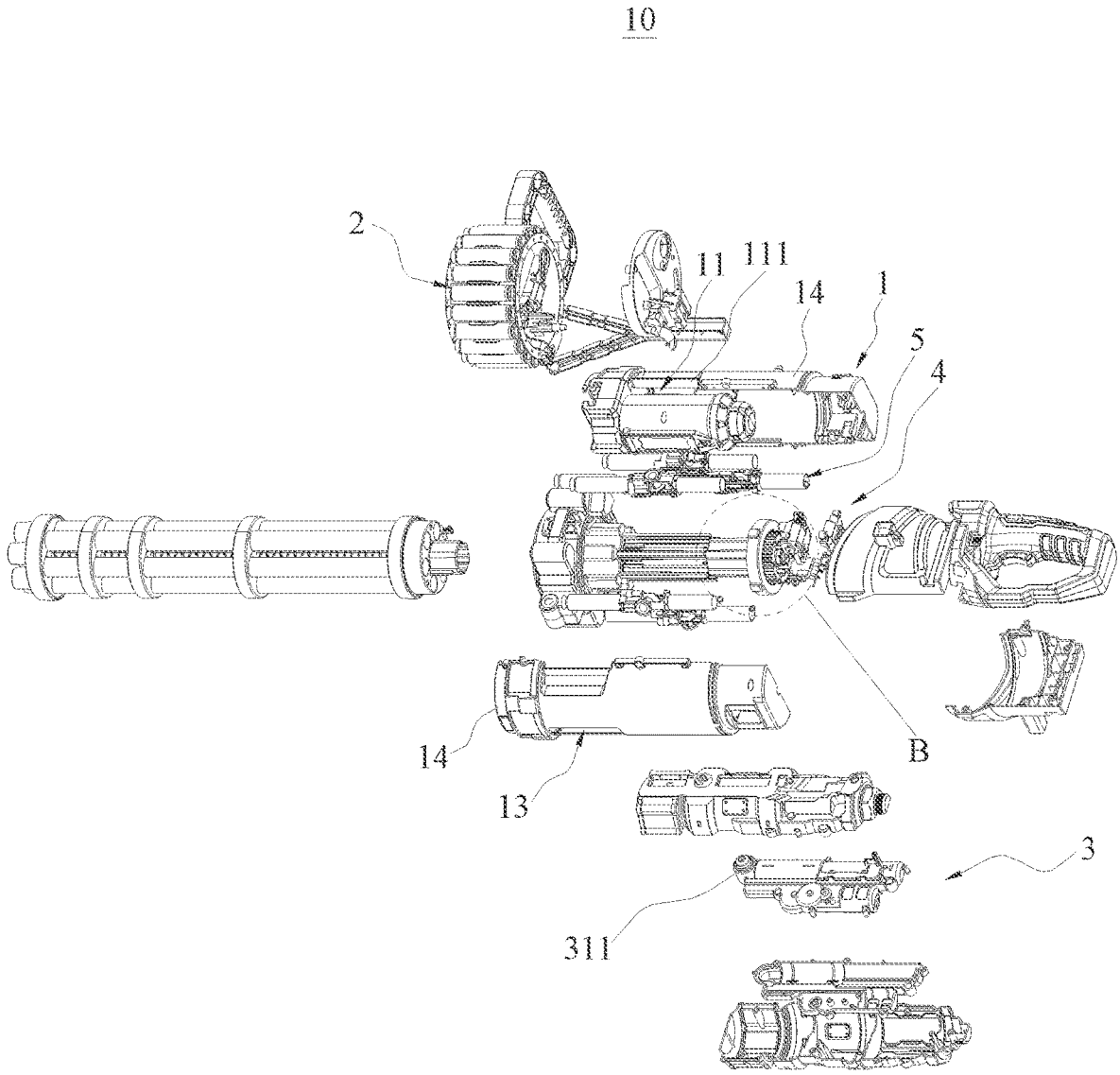
FIG. 4 is another exploded schematic diagram of the shooting toy shown in FIG. 1.

As shown in FIGS. 4 and 5, in some embodiments, the pumping device 3 comprises a pumping cylinder 31 communicated with the launching position 12, a piston 32 slidably arranged in the pumping cylinder 31, and a pumping driving assembly 33 connected with the piston 32. The pumping driving assembly 33 drives the piston 32 to slide in the pumping cylinder 31, so that the pressurized air in the pumping cylinder 31 is pumped to the launching position 12.

It is understood that the pumping cylinder 31 is in a shape of a cylinder. The piston 32 tightly abuts against an inner wall of the pumping cylinder 31 to smoothly pressurize and pump the air in the pumping cylinder 31. The pumping driving assembly 33 is configured to drive the piston 32 to slide along the pumping cylinder 31.

It is noted that the pumping cylinder 31 is connected to the launching position 12 through an air guide elbow and/or an air guide pipe. Furthermore, additional components such as a one-way valve can be provided, so that a vacuum space is not formed in the pumping cylinder 31 when the piston 32 withdraws, which avoids suck-back of the pressurized air to the launching position 12.

Optionally, the one-way valve may be arranged on the piston 32 or arranged on the pumping cylinder 31, only if the one-way valve enables a directional pumping of the pressurized air.

As shown in FIGS. 4 and 5, in some embodiments, the pumping driving assembly 33 comprises a pumping motor 331, a pumping intermittent gear 332 connected with the pumping motor 331, a rack 333 arranged on the piston 32, and a pumping elastic piece 334 connected with the piston 32. The pumping motor 331 is configured to drive the pumping intermittent gear 332 to rotate, so that the pumping intermittent gear 332 is intermittently engaged with the rack 333.

When the rack 333 is engaged with the pumping intermittent gear 332, the pumping intermittent gear 332 is configured to drive the rack 333 to slide, so that the piston 32 slides in a direction exiting the pumping cylinder 31, and the pumping elastic piece 334 deforms to generate elastic potential energy. When the rack 333 is separated from the pumping intermittent gear 332, the elastic potential energy of the pumping elastic piece 334 is released, so that the pumping elastic piece 334 drives the piston 32 to slide in a direction entering into the pumping cylinder 31.

It is understood that the pumping motor 331 is configured to generate torque by energizing and is further configured to transmit the torque to the pumping intermittent gear 332. Teeth engaged with the rack are intermittently arranged on the pumping intermittent gear 332, a structure of which can be referred from intermittent gears in the prior art. The rack 333 synchronously moves with the piston 32. When one of the rack 333 and the piston 32 moves, the other one is driven to move synchronously, realizing power transmission. The pumping elastic piece 334 is configured to provide elasticity to the piston 32.

It is also understood that the rack 333 may be directly arranged on the piston 32 or may be indirectly connected to the piston 32 through, for example, a block, a plate, or a column. Specifically, the rack 333 and the piston 32 are separately connected to the block, the plate, or the column, so a relative positions of the rack 333 and the piston 32 is fixed. A sliding stroke of the piston 32 in the pumping cylinder 31 is flexibly set. When the piston 32 slides in a direction away from the pumping cylinder 31 to a maximum of the slide stroke, the piston 32 is still arranged in the pumping cylinder 31, or the piston 32 is partially exposed or completely exposed outside the pumping cylinder 31.

It should be noted that during the rotation process, the pumping intermittent gear 332 is intermittently engaged with the rack 333, and only when the pumping intermittent gear 332 is engaged with the rack 333, the power of the pumping motor 331 is transmitted to the rack 333, so the rack 333 drives the piston 32 to slide away from the pumping cylinder 31. During this process, external air enters the pumping cylinder 31 for next pressurizing and pumping. During this process, deformation of the pumping elastic piece 334 continuously increases, and the elastic potential energy of the pumping elastic piece 334 increases accordingly.

Then, when the pumping intermittent gear 332 rotates until it is separated from the rack 333, i.e., the pumping intermittent gear 332 is no longer engaged with the rack 333, the pumping elastic piece 334 is released and is reset. During a reset process, the pumping elastic piece 334 pushes the piston 32 to slide in the pumping cylinder 31 to pressurize the external air and pump the pressurized air.

Subsequently, the piston 32 drives the rack 333 to slide synchronously, and the rack 333 moves to engage with the pumping intermittent gear 332 again. The rotation of the pumping intermittent gear 332 cycles and is repeated again and again.

In the cycle, the external air is continuous pressurized and the pressurized air is continuous pumped to ensure that each of the soft bullets 20 rotated to the launching position 12 is driven to shoot out. The present disclosure has the continuous shooting performance of the soft bullets 20 on a basis that the rotating device 4 drives the soft bullets 20 to the launching position continuously.

As shown in FIGS. 4 and 5, in some embodiments, an air outlet nozzle 311 is arranged on the pumping cylinder 31. The air outlet nozzle 311 extends to abut against the gun body 1. The air outlet nozzle 311 is aligned with and communicated with the launching position 12.

It is understood that the air outlet nozzle 311 is connected with the pumping cylinder 31 by a first plug-in structure, and a sealing ring is arranged on a joint of the air outlet nozzle 311 and the pumping cylinder 31. The air outlet nozzle 311 is connected with the launching position 12 by a second plug-in structure, and a joint of the air outlet nozzle 311 and the launching position 12 is sealed by a flexible piece.

It should be noted that the air outlet nozzle 311 is L-shaped or straight, depending on the relative position of the pumping cylinder 31 and the launching position 12.

Figure 6:
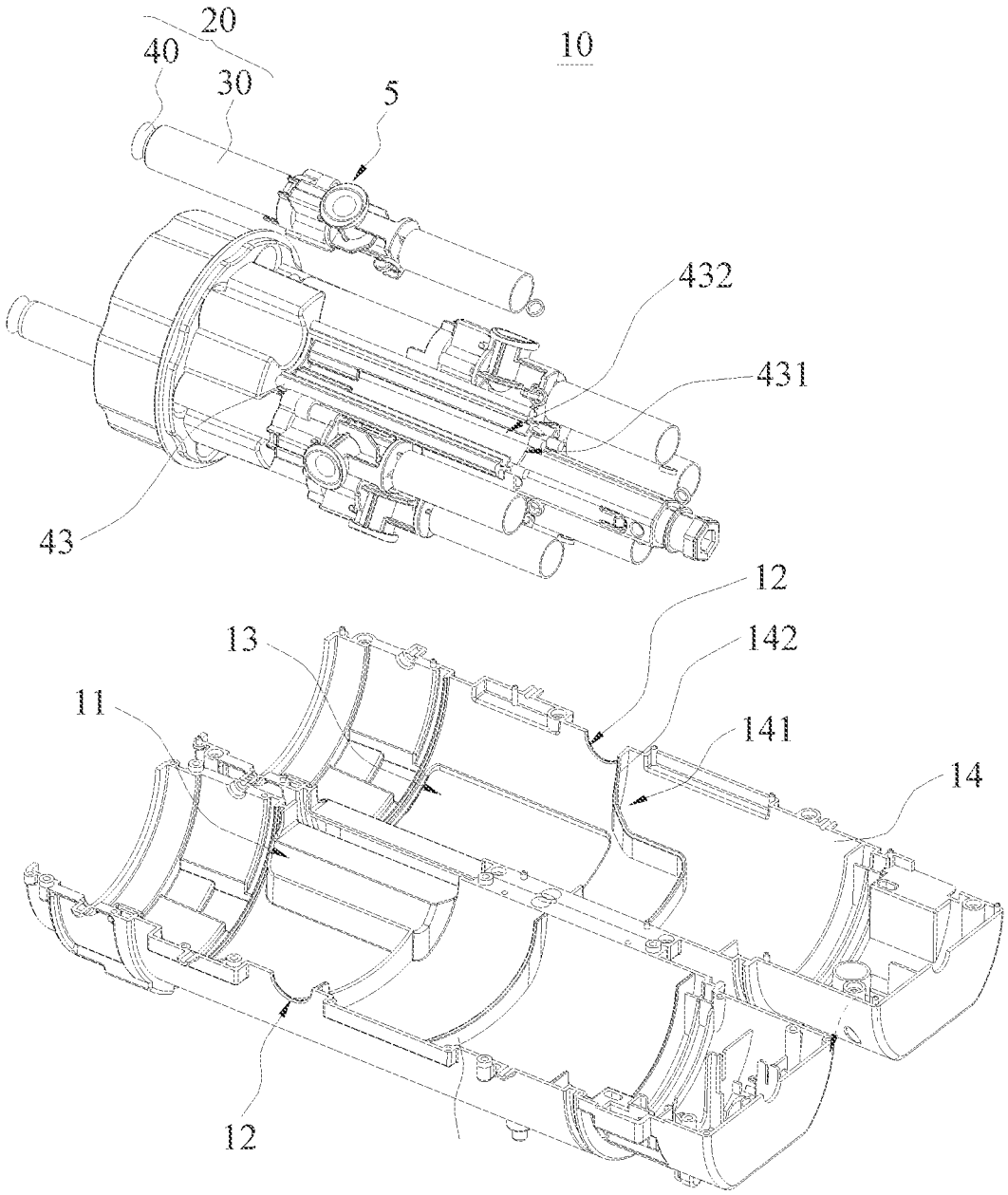
FIG. 6 is an exploded schematic diagram showing portions of the shooting toy shown in FIG. 3.
Figure 7:
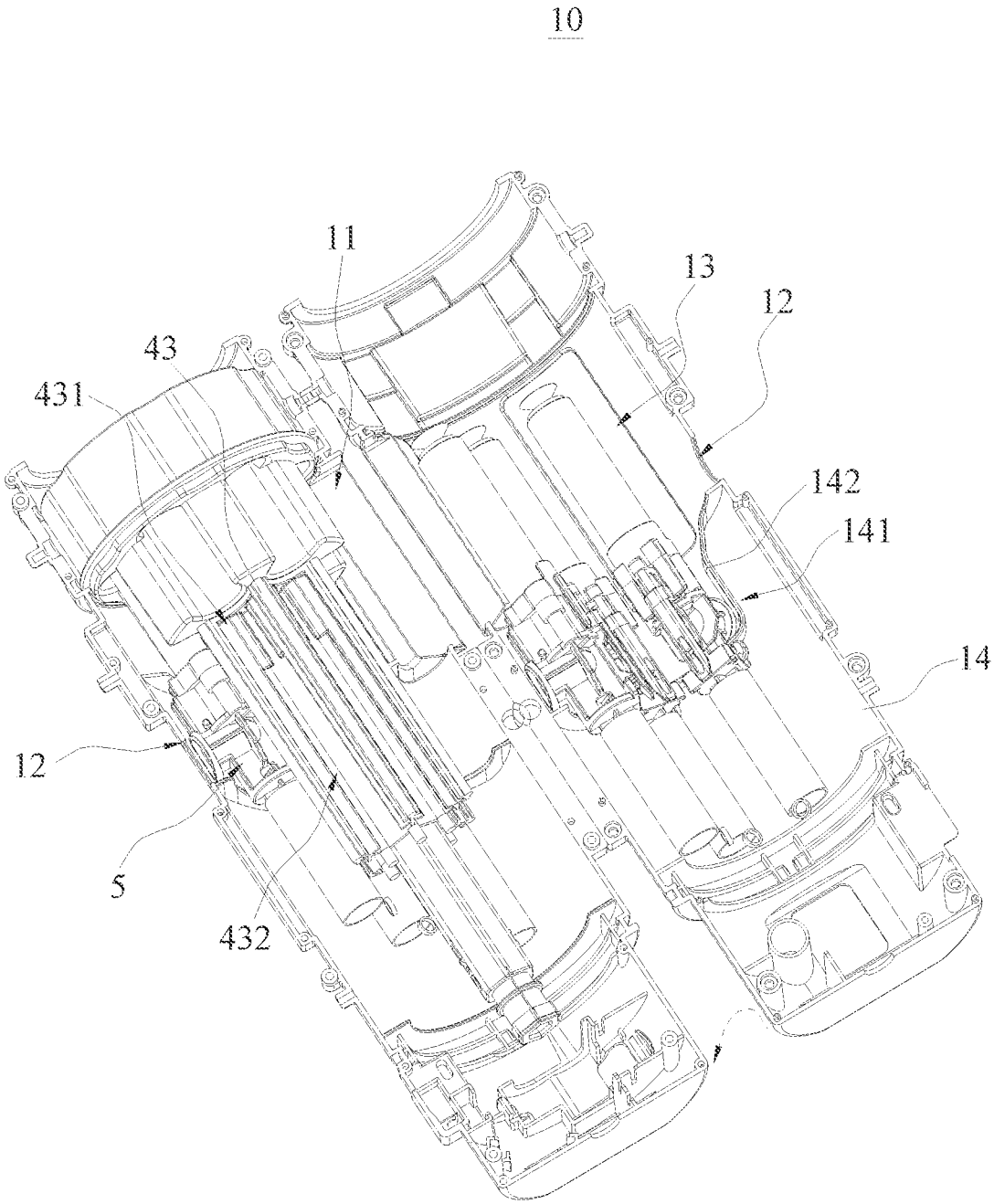
FIG. 7 is another exploded schematic diagram of the shooting toy shown in FIG. 6.
Figure 9:
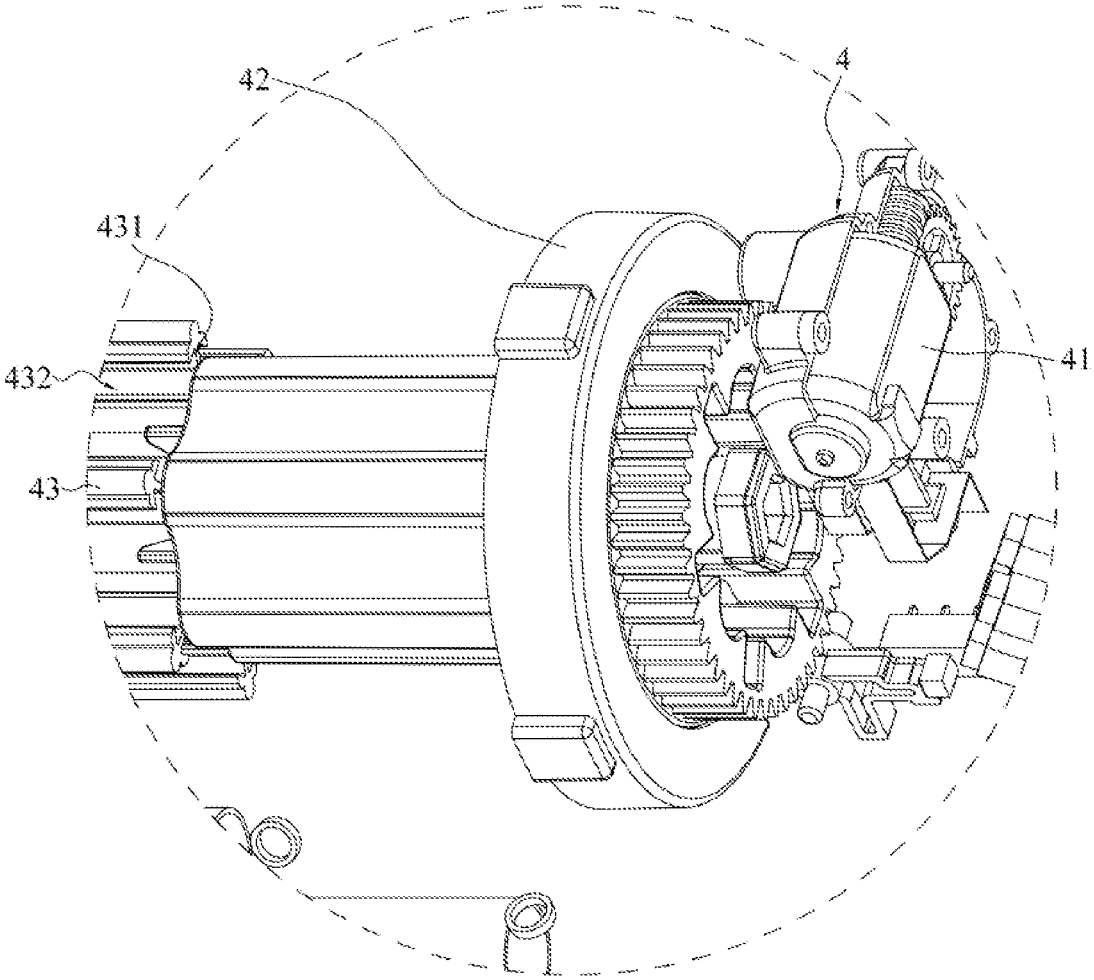
FIG. 9 is an enlarged schematic diagram of area B shown in FIG. 4.

As shown in FIGS. 6, 7, and 9, in some embodiments, the rotating device 4 comprises a rotating driving piece 41 arranged on the gun body 1, a rotating disk 42 rotatably arranged in the gun body 1, and a rotating columns 43 arranged on the rotating disk.

The rotating column 43 is arranged in the gun body 1. A plurality of accommodating grooves 432 are formed in the rotating column 43 in a circumferential direction thereof. Each of the accommodating grooves 432 defines a corresponding bullet accommodating cavity 431 in the rotating column 43. The rotating driving piece 41 is configured to drive the rotating disk 42 to rotate, so that the rotating disk 42 drives the rotating column 43 to rotate and the rotating column 43 drives the soft bullets 20 to rotate.

It is understood that the rotating driving piece 41 is configured to drive the rotating disk 42 to rotate. The rotating disk 42 is configured to fix the rotating column 43 and drives the rotating column 43 to rotate. The rotating column 43 is configured to drive a plurality of shell unloading aids 5 to rotate, thereby driving the soft bullets 20 to rotate.

It should be noted that the rotating driving piece 41 may a motor, and a center axis of the rotating column 43 coincides with a center axis of the rotating disk 42.

As shown in FIGS. 2-7, in some embodiments, the gun body 1 further defines a shell unloading position 13. The hell unloading position is configured to unload the soft bullets 20 after each bullet body is shot out. Specifically, when each of the soft bullets are shot out, each bullet body 40 is shot from each bullet shell 30, and each bullet shell in the vacant state is still accommodated in each of the bullet accommodating cavities. Subsequently, along with the rotation of the rotating device 4, each bullet shell 30 rotates to the shell unloading position 13 and is ejected through the shell unloading position 13, completing unloading of each bullet shell in the vacant state.

As shown in FIGS. 2, 4, 6, and 10, in some embodiments, the shooting toy further comprises the plurality of shell unloading aids 5, the plurality of shell unloading aids 5 is one-to-one arranged in the plurality of bullet accommodating cavities 431.

It is understood that the plurality of shell unloading aids 5 is provided. Optionally, the number of the plurality of shell unloading aids 5 is equal to the plurality of bullet accommodating cavities 431. Each of the shell unloading aids 5 is arranged in each of the bullet accommodating cavities 431.

When one of the plurality of bullet accommodating cavities 431 is in the bullet loading position, a corresponding shell unloading aid 5 of the plurality of shell unloading aids is configured to fix a corresponding soft bullet 20 falling into the one of the plurality of bullet accommodating cavities 431 via the bullet loading position 11.

When the one of the plurality of bullet accommodating cavities 431 is in the launching position 12, the corresponding shell unloading aid 5 is configured to guide the pressurized air from the pumping device 3 to the corresponding soft bullet 20, so that the corresponding soft bullet 20 is shot out.

When the one of the plurality of bullet accommodating cavities 431 is rotated to the shell unloading position 13, the corresponding shell unloading aid 5 is further configured to release the corresponding soft bullet 20 in the vacant state, so that the corresponding soft bullet 20 is ejected through the shell unloading position 13.

It is understood that the plurality of shell unloading aids 5 is rotated by the rotating device 4, and each of the shell unloading aids 5 is limited to move within a corresponding bullet accommodating cavity 431.

It is noted that functions of the plurality of shell unloading aids 5 are different as the rotating device 4 rotates to different positions.

When the one of the plurality of bullet accommodating cavities 431 is rotated to the bullet loading position 11, the corresponding shell unloading aids 5 accommodated in the one of the plurality of bullet accommodating cavities 431 moves within the one of the plurality of bullet accommodating cavities 431, thus defining a space of sufficient size and aligned with the bullet loading position 11 in the one of the plurality of bullet accommodating cavities 431. Thus, one of the soft bullets loaded by the bullet-holding device 2 smoothly falls into the one of the plurality of bullet accommodating cavities 431 located in the bullet loading position 11.

In a process of rotating from the bullet loading position 11 to the launching position 12, the corresponding shell unloading aid 5 moves in the one of the plurality of bullet accommodating cavities 431 again, so that the corresponding soft bullet 20 in the one of the plurality of bullet accommodating cavities 431 is fixed by the corresponding shell unloading aid 5, and thus a position of each of the soft bullets 20 in the plurality of bullet accommodating cavities is determined. Thus, a fixing position and a fixing degree of each of the soft bullets 20 to be shot are unified and guaranteed to ensure that each of the soft bullets 20 is accurately shot out in following processes.

When the one of the plurality of bullet accommodating cavities 431 is rotated to the launching position 12, the corresponding shell unloading aid 5 further guides the pressurized air pumped by the pumping device 3 to the corresponding soft bullet 20, making a corresponding bullet body 40 in a corresponding bullet shell 30 of the corresponding soft bullet 20 to shot out along the predetermined trajectory by pushing of the pressurized air.

During a process of the one of the plurality of bullet accommodating cavities 431 rotating from the launching position 12 to the shell unloading position 13 with the corresponding bullet shell 30 in the vacant state still fixed to the corresponding shell unloading aid 5, the corresponding shell unloading aid 5 drives the bullet shell 30 to synchronously move within the one of the plurality of bullet accommodating cavities 431, thereby driving the corresponding bullet shell 30 of the corresponding soft bullet in the vacant state to a predetermined position of the one of the plurality of bullet accommodating cavities 431.

When the one of the plurality of bullet accommodating cavities 431 is rotated to the shell unloading position 13, the corresponding shell unloading aid 5 no longer fixes the corresponding soft bullet 20 and defines a space for the corresponding soft bullet 20 to unload from the shell unloading position 13, so that the corresponding bullet shell 30 of the corresponding soft bullet 20 in the vacant state and left in the one of the plurality of bullet accommodating cavities 431 automatically unloads from the gun body. Therefore, each bullet shell 30 is automatically ejected.

In summary, the shooting toy eliminates the tedium of unloading each bullet shell and further improves the ease of use.

As shown in FIGS. 2-7, in some embodiments, the gun body 1 further comprises a rotating cylinder 14. The rotating device 4 is arranged in the rotating cylinder 14. A guide track 141 is arranged on an inner wall of the rotating cylinder 14. The bullet loading position 11, the launching position 12, and the shell unloading position 13 are defined on a side wall of the rotating cylinder 14 and correspond to different positions of the guide track 141.

It is understood that the rotating cylinder 14 is in a shape of a cylinder, and a plurality of limit spaces is defined between the plurality of bullet accommodating cavities 431 and the inner wall of the rotating cylinder 14. That is, each of the bullet accommodating cavities 431 faces the inner wall of the rotating cylinder 14 during rotation, so that each of the shell unloading aids 5 and each of the soft bullets 20 are limited between the inner wall of the rotating cylinder 14 and each of the bullet accommodating cavities 431 to avoid interference of each two soft bullets arranged in each two adjacent bullet accommodating cavities 431. The guiding track 141 is configured to guide each of the shell unloading aids 5 to slide on the inner wall of the rotating cylinder 14, so as to drive each of the shell unloading aids 5 in each of the bullet accommodating cavities 431 to slide to each predetermined position in each of the bullet accommodating cavities 431. Thus, each of the bullet accommodating cavities 431 accurately moves to each predetermined position during the rotation process, and finally each of the soft bullets realizes operations of loading, launching, and unloading in the bullet loading position 11, the launching position 12, and the shell unloading position 13 respectively.

Each of the shell unloading aids 5 comprises a fixing base 51 defining a fixing groove 511 and an air guide channel 512, an elastic piece 52 connected to the fixing base 51, a fixing piece 53 arranged in the fixing groove 511, and a shell unloading piece 54 slidably arranged on the fixing base 51.

The air guide channel 512 is configured to guide the pressurized air to flow. When the rotating device 4 rotates in the rotating cylinder 14, each fixing base 52 moves along the guide track 141 under an elastic force of each elastic piece 52, so that each fixing base 51 slides in each of the bullet accommodating cavities 431.

When a corresponding fixing base 51 of the corresponding shell unloading aid 5 moves into the shell unloading position 13 along the guide track 141, a corresponding shell unloading piece 54 stretches into a corresponding fixing groove 511, so that the corresponding soft bullet 20 is jacked to incline and is separated from a corresponding fixing piece 53. Then the corresponding soft bullet 20 is ejected from a corresponding fixing groove 511 and is ejected through the shell unloading position 13. When the corresponding fixing base 51 moves out of the shell unloading position 13 along the guide track 141, the corresponding shell unloading piece 54 resets and moves out of the corresponding fixing groove 511.

It is understood that each fixing base 51 accommodates and limits each of the soft bullets 20. Each elastic piece 52 is configured to provide elasticity to each fixing base, so that each fixing base 51 abuts against the guide track 141, ensuring that each fixing base 51 is able to slide along the guide track 141. Each fixing piece 53 is configured to fix each of the soft bullets 20 to each fixing base 51. Each shell unloading piece 54 is configured to eject each of the soft bullets 20 fixed in each fixing base 51 to realize the unloading of each of the soft bullets when required.

Each fixing groove 511 is matched with a profile of an end of each of the soft bullets 20 to ensure that the end of each of the soft bullets 20 is insertable into each fixing groove 511, thereby ensuring that each of the soft bullets 20 is fixed by each fixing piece 53 arranged in each fixing groove 511. Each air guide channel 512 is configured to guide the pressurized air input from the pumping device 3 to each of the soft bullets 20 in each fixing groove 511, so that each bullet body 40 in each bullet shell 30 is shot out under pushing of the pressurized air.

It should be noted that the rotation of the rotating device 4 and the elasticity of each elastic piece 52 make each fixing base 51 to slide along the guide track 141. That is, each fixing base 51 is always located on the guide track 141. Along with a track change of the guide track 141, each fixing base 51 moves relative to the inner wall of the rotating cylinder 14. With regard to each of the bullet accommodating cavities 431, each fixing base 51 is sliding back and forth along each of the bullet accommodating cavities 431.

Therefore, the guide track 141 corresponding to the bullet loading position is defined on the bullet loading position 11 of the rotating cylinder 14. That is, the position of the guide track thereto is corresponding to a relative position between the corresponding fixing base 51 located at the bullet loading position 11 and the bullet loading position 11, ensuring that the corresponding fixing base 51 rotated to the bullet loading position 11 defines enough space for a corresponding soft bullet 20 to fall into a corresponding bullet accommodating cavity 431. Similarly, the position of the guide track 141 corresponding to the launching position 12 and the position of the guide track 141 corresponding to the shell unloading position 13 are determined according to the position of the corresponding fixing base 51.

It should also be noted that during the process that the one of the plurality of bullet accommodating cavities 431 is rotated into the shell unloading position 13, the guide track 141 have a substantial trajectory drop change, and the corresponding fixing base 51 moves rapidly under driving of a corresponding elastic piece 52. When the corresponding fixing base 51 moves to a low position of the substantial trajectory drop change, a corresponding shell unloading piece 54 is jacked to stretch into the corresponding fixing groove 511 to eject the corresponding soft bullet 20.

Furthermore, a spring abutting against a corresponding shell unloading piece 54 is arranged on each fixing base 51. Thus, when each fixing base 51 is pulled by the corresponding elastic piece 52 and slides rapidly to the low position of the substantial trajectory drop change, the corresponding shell unloading piece is pushed and is unlocked from each fixing base 51. The corresponding shell unloading piece 54 stretches out of the bottom of the corresponding fixing groove 511 under driving of the spring, thus pushing the corresponding soft bullet 20 to incline, so the corresponding soft bullet 20 is smoothly released from the gun body 1.

Subsequently, when the one fixing base 51 is moved to the position of the guide track 141 corresponding to the bullet loading position 11 and continues to rotate, at this time, the corresponding soft bullet 20 is accommodated in the corresponding bullet accommodating cavity 431, the one fixing base 51 pushes the corresponding soft bullet 20 to move towards an edge of the corresponding bullet accommodating cavity 431. Then, the corresponding soft bullet 20 pushes the corresponding shell unloading piece 54 to retract into a groove wall of the corresponding fixing groove 511. Finally, the corresponding shell unloading piece 54 is clamped in the corresponding fixing base again, so that when the corresponding fixing base rotates to the shell unloading position 13 again, the corresponding shell unloading piece 54 is unlocked and released to stretch out for unloading the corresponding soft bullet.

As shown in FIGS. 6 and 7, in some embodiments, a guide convex wall 142 is arranged on the inner wall of the rotating cylinder 14 along the guide track 141.

A guide boss 513 facing the guide convex wall 142 is arranged on each fixing base 51. Each guide boss 513 is configured to abut against the guide convex wall 142 under an action of each elastic piece 52. A first end of each air guide channel 512 is exposed on each guide boss 513, and a second end of each air guide channel is exposed in each fixing groove 511.

It is understood that the guide convex wall 142 is optionally configured as a continuous flange. Each guide boss 513 is tightly attached to the guide convex wall 142 by each elastic piece 52. When the one of the plurality of bullet accommodating cavities 431 is in the launching position 12, a corresponding guide boss 513 is moved to a corresponding position for introducing the pressurized air by the corresponding fixing base 51, so that the air around the rotating device 4 is smoothly introduced into a corresponding air guide channel 512 and the air is further guided to the corresponding fixing groove and ejects out. Thus, the bullet body 40 in the corresponding bullet shell 30 is shot out.

The shooting toy of the presently disclosure relates to a technical field of toys. The bullet loading device automatically loads the soft bullets. The rotating device automatically pushes the soft bullets loaded to the bullet loading position to the launching position one by one, and the pumping device boosts the soft bullets to shot out. During a shooting process, the rotating device continuously pushes the soft bullets to the launching position, and the pumping device boosts and shoots each of the soft bullets that moves to the launching position.

Thus, the shooting toy eliminates tedious manual loading of the soft bullets, improves a convenience of operation, and further realizes continuous shooting of the soft bullets, which makes the shooting toy have excellent continuous shooting performance.

The above embodiments are intended to illustrate the technical concept and features of the present disclosure, and are intended to enable those skilled in the art to understand the contents of the present disclosure and implement them accordingly, which do not limit the protection scope of the present disclosure. All variations and modifications made within the scope of the claims of the present disclosure shall fall within the protection scope of the present disclosure.

What is claimed is:

1. A shooting toy, comprising:

a gun body defining a bullet loading position and a launching position;

a bullet loading device rotatably arranged on an outer side of the gun body;

a pumping device communicated with the launching position; and a rotating device rotatably arranged in the gun body;

wherein the rotating device defines a plurality of bullet accommodating cavities in a circumferential direction thereof; and the rotating device is configured to drive the plurality of bullet accommodating cavities to rotate in the gun body, so that the plurality of bullet accommodating cavities rotates to the bullet loading position and the launching position in turn;

wherein the bullet loading device is configured to load soft bullets to the bullet loading position during a rotation process, so that the soft bullets are one-to-one loaded in the plurality of bullet accommodating cavities;

wherein the pumping device is configured to pressurize air and pump pressurized air to the launching position, so that the pressurized air is pumped to each of the bullet accommodating cavities during the rotation process, and each of the soft bullets is shot from the launching position under driving of the pressurized air;

the bullet loading device comprises a bullet loading support detachably arranged on the gun body, a bullet driving piece arranged on the bullet loading support, and an annular frame rotatably arranged on the bullet loading support;

a plurality of clamping grooves are provided in the annular frame; each of the clamping grooves is configured to accommodate a corresponding soft bullet of the soft bullets; the bullet driving piece is configured to drive the annular frame to rotate, so that the plurality of clamping grooves rotates and is communicated with the bullet loading position one by one in the rotation process, and the soft bullets accommodated in the plurality of clamping grooves fall into the bullet loading position one by one.

2. The shooting toy according to claim 1, wherein an edge of the bullet loading position protrudes outwards to form a bullet scraping boss; when the annular frame rotates, the bullet scraping boss pushes each of the soft bullets from a corresponding clamping groove of the plurality of clamping grooves, so that each of the soft bullets falls into the bullet loading position.

3. The shooting toy according to claim 1, wherein the pumping device comprises a pumping cylinder communicated with the launching position, a piston slidably arranged in the pumping cylinder, and a pumping driving assembly connected with the piston; wherein the pumping driving assembly drives the piston to slide in the pumping cylinder; so that the pressurized air in the pumping cylinder is pumped to the launching position.

4. The shooting toy according to claim 3, wherein the pumping driving assembly comprises a pumping motor, a pumping intermittent gear connected with the pumping motor, a rack arranged on the piston, and a pumping elastic piece connected with the piston;

wherein the pumping motor is configured to drive the pumping intermittent gear to rotate, so that the pumping intermittent gear is intermittently engaged with the rack;

wherein when the rack is engaged with the pumping intermittent gear, the pumping intermittent gear is configured to drive the rack to slide, so that the piston slides along a direction exiting the pumping cylinder, and the pumping elastic piece deforms to generate elastic potential energy; when the rack is separated from the pumping intermittent gear, the elastic potential energy of the pumping elastic piece is released, so that the pumping elastic piece drives the piston to slide along a direction entering into the pumping cylinder.

5. The shooting toy according to claim 3, wherein an air outlet nozzle is arranged on the pumping cylinder; the air outlet nozzle extends to abut against the gun body; the air outlet nozzle is aligned with and communicated with the launching position.

6. The shooting toy according to claim 1, wherein the rotating device comprises a rotating driving piece arranged on the gun body, a rotating disk rotatably arranged in the gun body, and a rotating column arranged on the rotating disk;

wherein the rotating column is arranged in the gun body; a plurality of accommodating grooves are formed in the rotating column in a circumferential direction thereof; each of the accommodating grooves defines a corresponding bullet accommodating cavity in the rotating column; the rotating driving piece is configured to drive the rotating disk to rotate, so that the rotating disk drives the rotating column to rotate and the rotating column drives the soft bullets to rotate.

7. The shooting toy according to claim 1, wherein the gun body further defines a shell unloading position;

wherein the shooting toy further comprises a plurality of shell unloading aids; the plurality of shell unloading aids is one-to-one arranged in the plurality of bullet accommodating cavities;

wherein when one of the plurality of bullet accommodating cavities is in the bullet loading position; a corresponding shell unloading aid of the plurality of shell unloading aids is configured to fix a corresponding soft bullet falling into the one of the plurality of bullet accommodating cavities via the bullet loading position;

wherein when the one of the plurality of bullet accommodating cavities is in the launching position, the corresponding shell unloading aid is configured to guide the pressurized air from the pumping device to the corresponding soft bullet, so that the corresponding soft bullet is shot out;

wherein when the one of the plurality of bullet accommodating cavities is rotated to the shell unloading position, the corresponding shell unloading aid is further configured to release the corresponding soft bullet in a vacant state, so that the corresponding soft bullet is ejected through the shell unloading position.

8. The shooting toy according to claim 7, wherein the gun body further comprises a rotating cylinder; the rotating device is arranged in the rotating cylinder; a guide track is arranged on an inner wall of the rotating cylinder; and the bullet loading position, the launching position, and the shell unloading position are defined on a side wall of the rotating cylinder and correspond to different positions of the guide track;

wherein each of the shell unloading aids comprises a fixing base defining a fixing groove and an air guide channel, an elastic piece connected to the fixing base, a fixing piece arranged in the fixing groove, and a shell unloading piece slidably arranged on the fixing base;

wherein the air guide channel is configured to guide the pressurized air to flow; when the rotating device rotates in the rotating cylinder, each fixing base moves along the guide track under an elastic force of each elastic piece, so that each fixing base slides in each of the bullet accommodating cavities;

when a corresponding fixing base of the corresponding shell unloading aid moves into a corresponding shell unloading position along the guide track, a corresponding shell unloading piece stretches into a corresponding fixing groove, so that the corresponding soft bullet is jacked to incline and is separated from a corresponding fixing piece; then the corresponding soft bullet is ejected from a corresponding fixing groove and is ejected through the shell unloading position; when the corresponding fixing base moves out of the shell unloading position along the guide track; the corresponding shell unloading piece resets and moves out of the corresponding fixing groove.

9. The shooting toy according to claim 8, wherein a guide convex wall is arranged on the inner wall of the rotating cylinder along the guide track;

wherein a guide boss facing the guide convex wall is arranged on each fixing base; each guide boss is configured to abut against the guide convex wall under an action of each elastic piece; a first end of each air guide channel is exposed on each guide boss, and a second end of each air guide channel is exposed in each fixing groove.

10. A shooting toy, comprising:

a gun body defining a bullet loading position and a launching position;

a bullet loading device rotatably arranged on an outer side of the gun body;

a pumping device communicated with the launching position; and a rotating device rotatably arranged in the gun body;

wherein the rotating device defines a plurality of bullet accommodating cavities in a circumferential direction thereof; and the rotating device is configured to drive the plurality of bullet accommodating cavities to rotate in the gun body, so that the plurality of bullet accommodating cavities rotates to the bullet loading position and the launching position in turn;

wherein the bullet loading device is configured to load soft bullets to the bullet loading position during a rotation process, so that the soft bullets are one-to-one loaded in the plurality of bullet accommodating cavities;

wherein the pumping device is configured to pressurize air and pump pressurized air to the launching position, so that the pressurized air is pumped to each of the bullet accommodating cavities during the rotation process, and each of the soft bullets is shot from the launching position under driving of the pressurized air;

wherein the gun body further defines a shell unloading position;

wherein the shooting toy further comprises a plurality of shell unloading aids; the plurality of shell unloading aids is one-to-one arranged in the plurality of bullet accommodating cavities;

wherein when one of the plurality of bullet accommodating cavities is in the bullet loading position; a corresponding shell unloading aid of the plurality of shell unloading aids is configured to fix a corresponding soft bullet falling into the one of the plurality of bullet accommodating cavities via the bullet loading position;

wherein when the one of the plurality of bullet accommodating cavities is in the launching position, the corresponding shell unloading aid is configured to guide the pressurized air from the pumping device to the corresponding soft bullet, so that the corresponding soft bullet is shot out;

wherein when the one of the plurality of bullet accommodating cavities is rotated to the shell unloading position, the corresponding shell unloading aid is further configured to release the corresponding soft bullet in a vacant state, so that the corresponding soft bullet is ejected through the shell unloading position.

* * * * *